US011587476B1

(12) United States Patent
Millar

(10) Patent No.: US 11,587,476 B1
(45) Date of Patent: Feb. 21, 2023

(54) FLAG ANTI-WRAPPING DEVICE

(71) Applicant: William Colin Millar, Boise, ID (US)

(72) Inventor: William Colin Millar, Boise, ID (US)

( * ) Notice: Subject to any disclaimer, the term of this patent is extended or adjusted under 35 U.S.C. 154(b) by 0 days.

(21) Appl. No.: 17/659,675

(22) Filed: Apr. 19, 2022

(51) Int. Cl.
*G09F 17/00* (2006.01)

(52) U.S. Cl.
CPC .. *G09F 17/0091* (2013.01); *G09F 2017/0058* (2013.01)

(58) Field of Classification Search
CPC ..... G09F 17/00; G09F 2017/0008; G09F 17/0091; F16C 19/24; F16C 1933/58; F16C 19/586; F16C 19/605; F16C 43/04; F16C 2226/60
See application file for complete search history.

(56) References Cited

U.S. PATENT DOCUMENTS 957,606 A * 5/1910 Hendricks et al. ..... G09F 17/00 211/38
1,448,825 A * 3/1923 Louis ..... G08B 5/14 116/173
1,554,758 A * 9/1925 Post ..... E04H 12/32 116/174
2,072,573 A * 3/1937 Vigliotti ..... A63B 57/40 40/606.15
2,507,623 A * 5/1950 Dionicio
2,799,240 A 7/1957 Andrews
3,587,520 A * 6/1971 Miller ..... E04H 12/32 52/146
5,044,301 A 9/1991 Peters
5,375,555 A 12/1994 Dolan
5,603,389 A * 2/1997 Zemon ..... A62B 35/0068 248/219.2
6,016,889 A * 1/2000 Pearcy ..... A62B 35/0068 248/219.2
8,069,811 B2 12/2011 Ciaccia

* cited by examiner

*Primary Examiner* — Cassandra Davis
(74) *Attorney, Agent, or Firm* — Kramer Law Clinic

(57) ABSTRACT

A flag anti-wrapping device for reducing friction and side loading, which are common causes of flag wrapping. The flag anti-wrapping device includes an inner race, an outer race, a plurality of roller bearings, and a cap. Roller bearings are placed in an annular cavity, which is defined by the outer race having an inner circumference with a diameter larger than an outer diameter of the inner race. Thus, a flag may rotate about a flagpole with reduced friction and side-loading. Thereby, eliminating side load binding and reducing wrapping of the flag about the flagpole.

7 Claims, 4 Drawing Sheets

FLAG ANTI-WRAPPING DEVICE

TECHNICAL FIELD

The invention generally relates to flag accessories. More specifically, this invention relates to anti-wrapping devices to aid in the full rotation of a flag about a flagpole.

BACKGROUND OF THE INVENTION

Many people own flags with wall mounted poles and face issues with the flag wrapping around the pole. This sometimes requires the owner to use a ladder and manually unwrap the flag. This becomes a daily battle during windy times of the year. Numerous flag accessories exist today that attempt to reducing wrapping by reducing friction between the flagpole and the accessory, which can allow the flag to rotate around the flagpole. However, these accessories are widely known to fail to prevent sideloading, which causes the device to bind and the flag to wrap around the flagpole.

Attempts have been made to reduce flag wrapping. U.S. Pat. No. 2,799,240 to Andrews describes a device which reduces friction through the use of ball bearings between an inner and outer race. However, this device does not address the issue of side loading. When wind gusts hit the flag and pull the swivel either up or down, it tends to bind as ball bearings are more suited to linear rotation, without side load. Therefore, the ball bearings may become jammed and prevent continued rotation around the pole. This side loading often leads the flag to wrapping and an owner needing to manually unwrap and reset the device.

Additionally, U.S. Pat. No. 8,069,811 to Ciaccia attempts to address side loading by locking two anti-wrapping devices in concert by using a rod to connect the two devices. This allows the two devices to move as one unit around a flagpole. However, the weight of the rod at the axis requires a greater counterweight, for example a heavier flag, to de-furl the flag. Without the heavy counterweight, this design promotes furling. To counteract the weight issue, U.S. Pat. No. 8,069,811 attempts to use bearings between the devices and the flagpole to reduce friction. But this does not eliminate binding, rather combining this feature with the torsion imposed by the connecting rods could cause binding and promote wrapping. Additionally, the use of a rod eliminates the ability for various sized flags, which is common for various manufacturers of flag types.

As such, there is a need for a flag anti-wrapping device which can accommodate many flagpole sizes while still reducing side-loading and subsequent wrapping of the mounted flag.

BRIEF SUMMARY OF THE INVENTION

It is therefore an object of the present invention to provide for a flag anti-wrapping device that can reduce side loading upon the device by reducing friction between the flag anti-wrapping device and the flagpole, which enables the weight of the flag to drag downwards due to gravitational force, thereby avoiding furling of the flag about the flagpole.

It is a further object of the present invention to provide for a flag anti-wrapping device which achieves the above object, and which also may accommodate flag poles and flags of various sizes.

The invention achieves the above objects, and other objects and advantages which will become apparent from the description which follows, by providing a flag anti-wrapping device including an inner race defining an inner diameter and an annular outer race adapted to be received on the inner race. The inner race is configured to receive a flagpole. The outer race defines an inner circumference having a diameter larger than the outer diameter of the inner race, so as to define an annular cavity between the inner race and outer race. A plurality of roller bearings are located in the annular cavity to reduce friction between the inner and outer races upon rotation of the outer race about the inner race. Additionally, the roller bearings are not susceptible to side loading. Finally, a cap is attached to the inner race to hold the outer race and inner race together.

DETAILED DESCRIPTION OF THE PREFERRED EMBODIMENTS

A flag anti-wrapping device in accordance with the principles of the invention is generally indicated at bracketed numeral 10 in the various Figures of the attached drawings wherein numbered elements in the figures correspond to like numbered elements herein.

Figure 1:
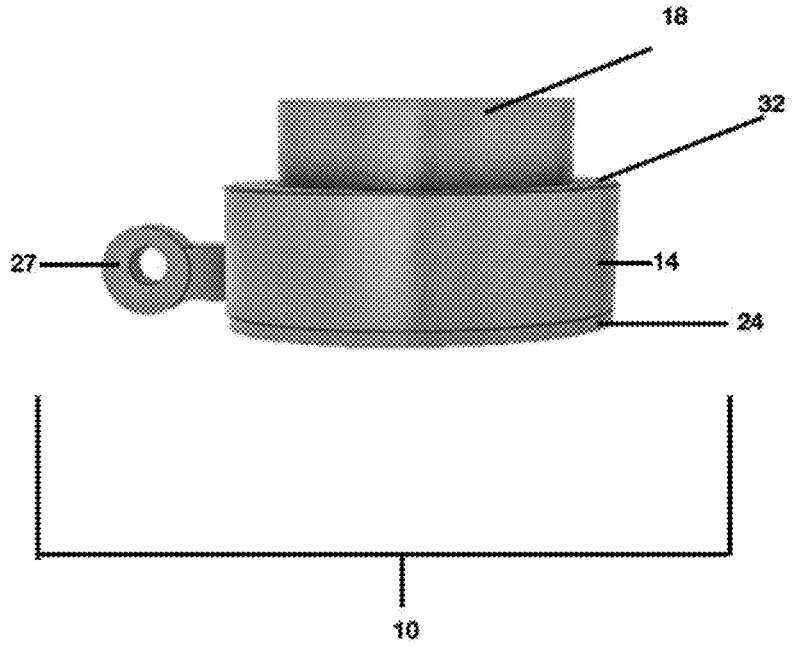
FIG. 1 is a side view of a flag anti-wrapping device.
Figure 2:
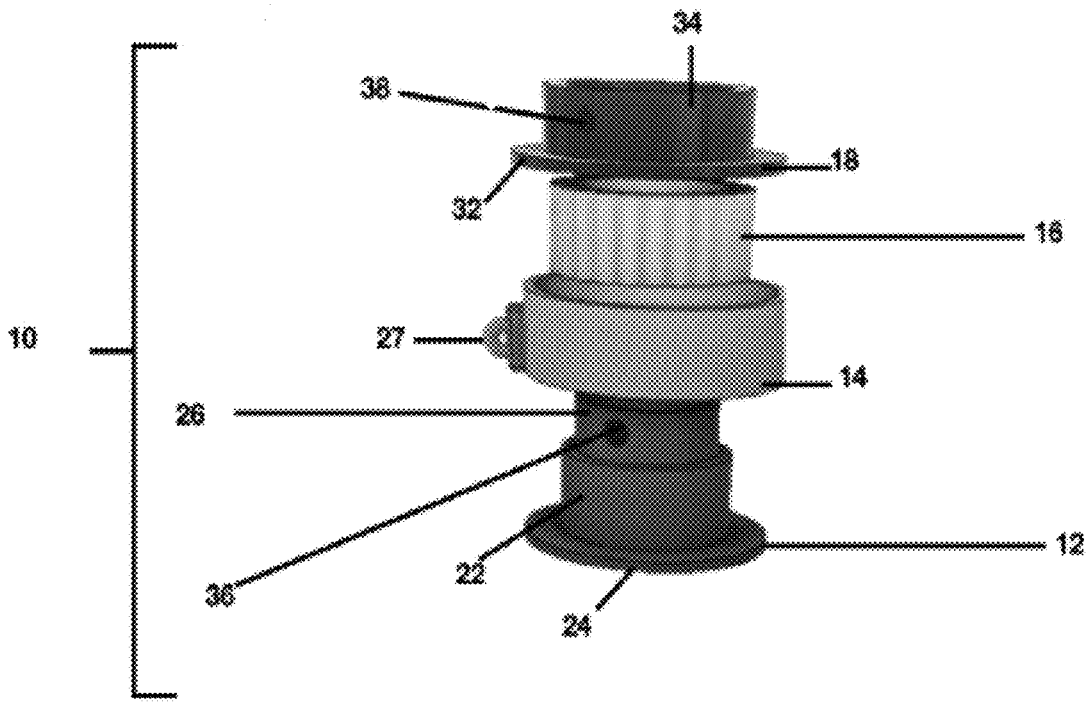
FIG. 2 is an exploded view of a flag anti-wrapping device.

Referring now to the drawings and initially to FIGS. 1 and 2, there is shown an exemplary flag anti-wrapping device 10, including an inner race 12, an outer race 14, a plurality of roller bearings 16, and a cap 18. When assembled, the flag anti-wrapping device 10 allows for the load of a flag 11 to be distributed over several roller bearings 16. In this way, the flag anti-wrapping device 10 reduces friction and eliminates side load binding between the flag anti-wrapping device 10 and a flagpole 13, which enables a flag 11 to rotate and avoid furling of the flag 11 about the flagpole 13.

Figure 3:
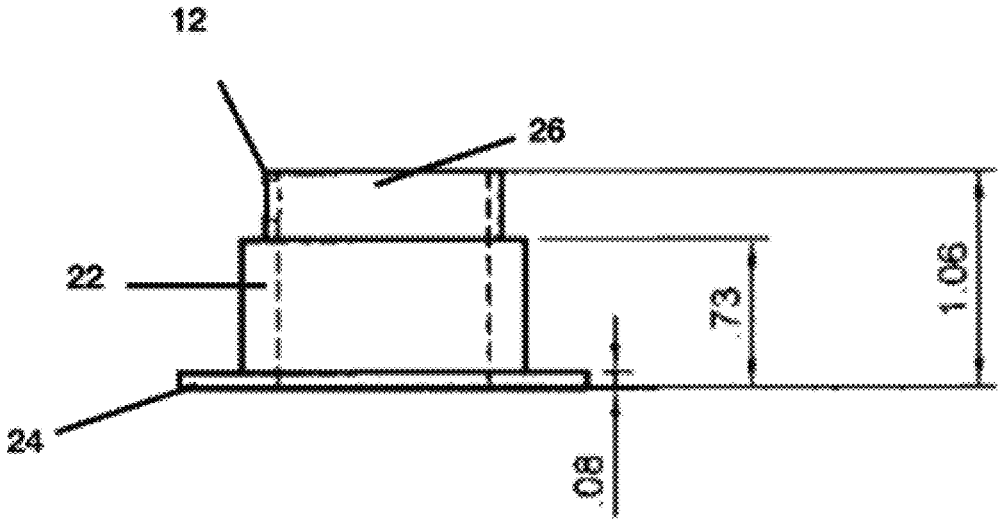
FIG. 3 is a side view of an inner race of a flag anti-wrapping device.
Figure 4:
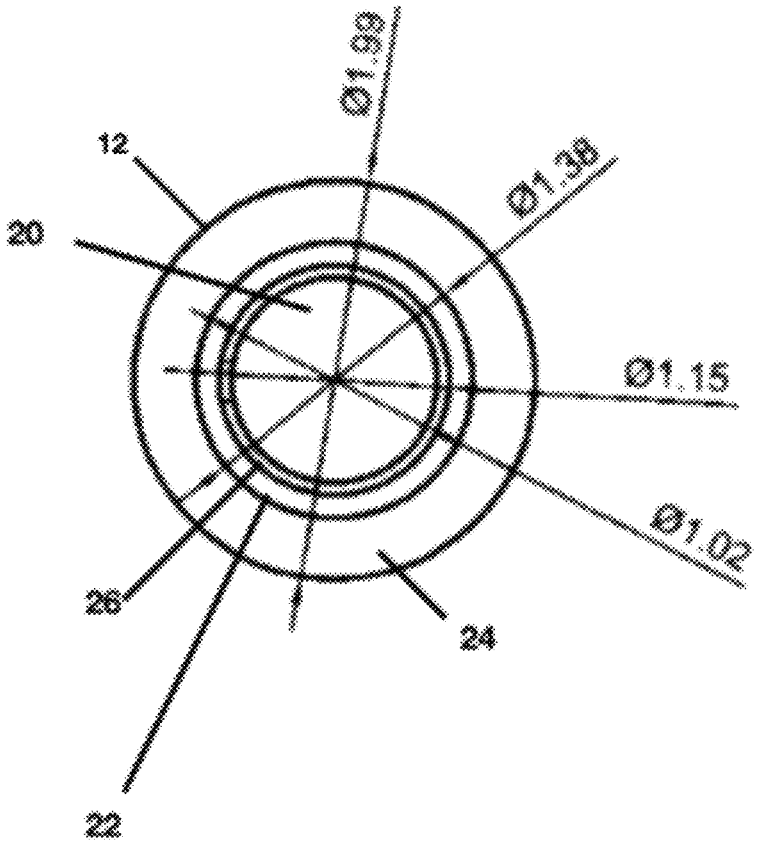
FIG. 4 is a top view of an inner race of a flag anti-wrapping device.

Referring now to FIGS. 3 and 4, the inner race 12 has an inner diameter 20 and an outer diameter 22. The inner diameter 20 is configured to receive a flagpole 13, so that the flag anti-furling device can be slid onto the flagpole 13. The inner race 12 has a first circumferential lip 24 attached to a bottom of the inner race 12. The circumferential lip 24 extends from the bottom of the inner race 12 radially outwards. The lip 24 is configured to prevent bearings 16 from falling out of the device 10. Additionally, the inner race 12 has a first annulus 26 extending up from the top of the inner race 12. The first annulus 26 is located between the inner diameter 20 and outer diameter 22. In the preferred embodiment, the inner race 12 is approximately 0.73 inches in height. The first annulus 26 extends approximately 0.33 inches from the top of the inner race 12. The outer diameter 22 is 1.38 inches and the inner diameter 20 is 1.02 inches.

Figure 5:
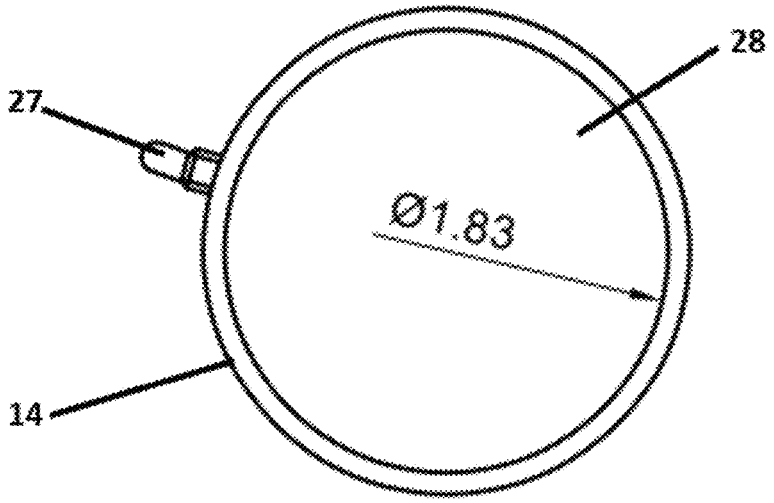
FIG. 5 is a top view of an outer race of a flag anti-wrapping device.

Referring now to FIG. 5, the outer race 14 has means 27 for attaching to a flag 11. As depicted, the means may be a protrusion 27 having a hole to receive a hook on a flag 11. The means 27 may also be an arm member, a shackle, a clip, a hook-and-loop fastener, a snap hook, a mounting ring, or other kind of flag fastener. Additionally, the outer race 14 has an inner circumference 28. The inner circumference 28 has a diameter larger than the outer diameter 22 of the inner race 12. Preferably, the inner circumference 28 of the outer race 14 has a diameter equal to the total diameter of the inner race 12 and the first circumferential lip 24. Therefore, when the outer race 14 is attached to the inner race 12, an annular cavity is defined by the space between the outer diameter 22 of the inner race 12 and inner circumference 28.

The annular cavity is configured for the roller bearings 16 to sit inside. In the preferred embodiment, the annular cavity is greater than the size of the bearings 16. The bearings 16 are each have a diameter of 0.20 inches and 0.59 inches high. The annular cavity being larger than the bearings 16 allows for some space between the bearings 16 and the walls of the annular cavity. The bearings 16 can rotate freely within the cavity, encouraging the rotation of a flag 11 about a flagpole 13.

Figure 6:
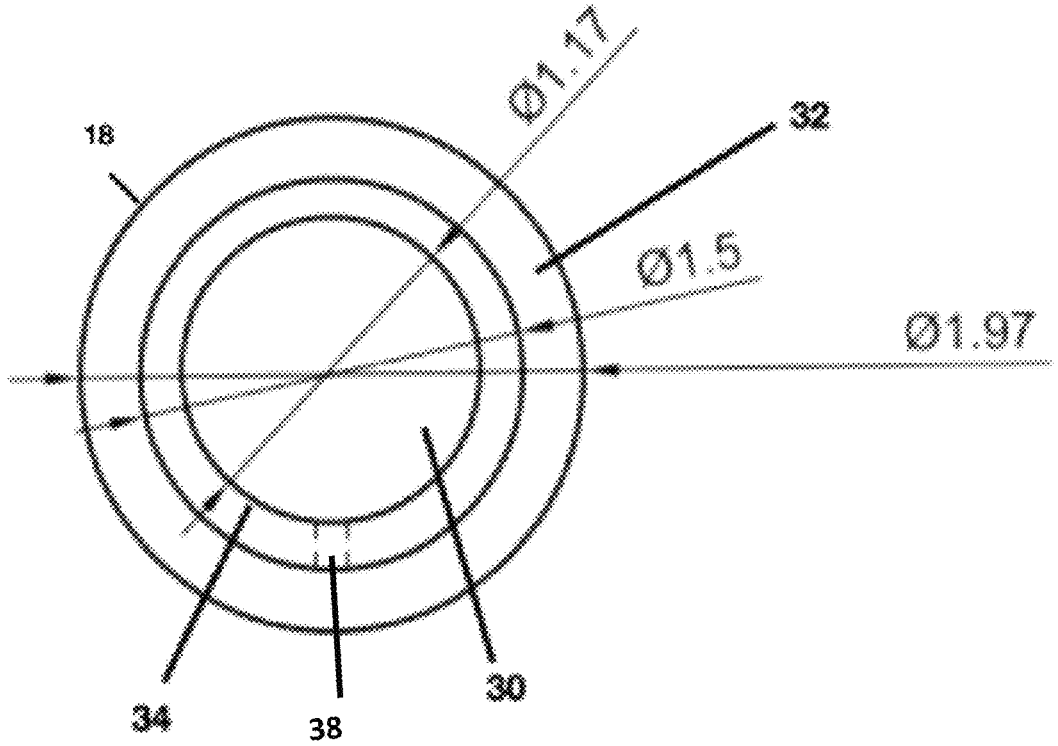
FIG. 6 is a top view of a cap of a flag anti-wrapping device

Referring now to FIG. 6, the cap 18 is configured to attach to the inner race 12 to hold the outer race 14 and inner race 12 together. The cap 18 has an inner diameter 30 configured to receive the inner race 12. Additionally, the cap 18 has a second radially extending circumferential lip 32 attached to the bottom of the cap 18. The circumferential lip 32 is extends from the bottom of the cap 18 radially outwards. The lip 32 is configured to prevent bearings 16 from falling out of the device 10. Additionally, the cap 18 has a second annulus 34 extending up from the top of the cap 18.

When assembled, the first radially extending circumferential lip 24 and the second radially extending circumferential lip 32 retain the bearings in the races 12, 14. The plurality of roller bearings 16 reside within the annular cavity between the races 12, 14. A proximal end of the bearings 16 is closely spaced with respect to the second radially extending circumferential lip 32 and a distal end is closely spaced with respect to the first radially extending circumferential lip 24. Therefore, the roller bearings 16 are held in place between the first lip 24 and the second lip 32.

Referring to FIGS. 1 and 2, the flag anti-wrapping device 10 depicted has a first annulus 26 extending from the top of the inner race 12 and a second annulus 34 extending from the top of the cap 18. The first annulus 26 and the second annulus 34 have means for attaching to each other, which allows the device 10 to be connected and unitary. As shown in FIG. 2, the means is a first hole 36 located on the first annulus 26 and a second hole 38 located on the second annulus 34. The first and second holes 36, 38 can be aligned to receive a fastener, such as a screw, nail, rope, or string to hold the inner and outer races 12, 14 together. Alternatively, the cap 18 may have inner threads configured to receive outer threads located on the inner race 12. In such embodiment, the inner threads and outer threads can be twisted together to hold the inner and outer races 12, 14 together. Further, the means may include adhesives, such as glue or tape, to hold the flag anti-wrapping device 10 together.

Figure 7:
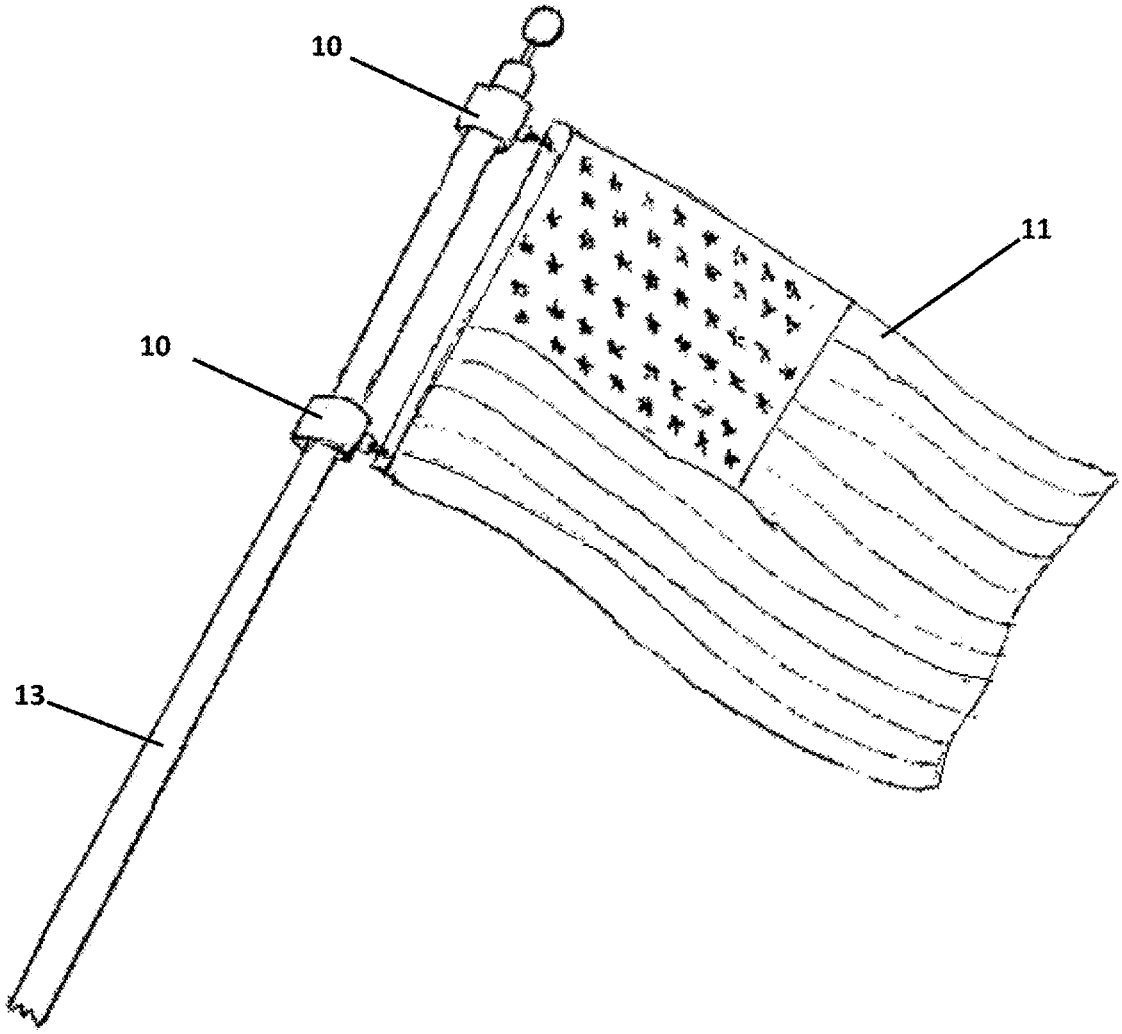
FIG. 7 is a side elevation view of an exemplary flag assembly embodying features of the present invention.

Additionally, the first and second holes 36, 38 are used for attaching the flag anti-wrapping device 10 to a flagpole 13. To attach the device 10 to a flagpole 13, first, the holes 36, 38 are aligned. Then, the inner race 12 and cap 18 are attached through a friction fit or an adhesive. Finally, a set screw, not shown, is threaded through the holes 36, 38 and holds the device 10 to the flagpole 13. One or both of the holes 36, 38 can be threaded to hold the set screw in place. Therefore, the first and second holes 36, 38 attach the inner race 12 and cap 18 together to make the device 10 unitary, as well, as attach the device 10 to a flagpole 13, as shown in FIG. 7. In the preferred embodiment, only the second hole 38 located on the cap 18 is threaded. The inner race 12, then has a larger through hole 36 for receiving a fastener to fasten the device to a flagpole 13.

The device 10 can be made of any suitable material, such as metal or plastic. A preferred method for making the features of the flag anti-wrapping device 10 is through injection molding and 3D-printing. Each feature can be 3D-printed separately and then assembled and attached as described above. For example, 3D printing or injection molding would allow for the outer race 14 and the means for attaching 27 to be a single, unitary structure. However, other methods for manufacturing, including, but not limited to, casting and blow molding can also be used. Welding, adhesives, or fasteners may also be for attaching features together.

Referring to FIG. 7, a flag 11 can be mounted on a flagpole 13 by attaching two flag anti-furling devices 10. When attached to the flag 11 and the flagpole 13, the flag anti-furling device 10 reduces side loading upon the device by having the roller bearings 16 reduce the friction between the flag anti-wrapping device 10 and the flagpole 13. This enables the weight of the flag 11 to drag downwards due to gravitational force, thereby avoiding wrapping of the flag 11 about the flagpole 13. The anti-wrapping effect continues even when the flag 11 is pulled by the wind in any direction.

Those of ordinary skill in the art will conceive of other alternate embodiments of the invention upon reviewing this disclosure. Thus, the invention is not to be limited to the above description but is to be determined in scope by the claims which follow.

What is claimed is:

1. A flag anti-wrapping device, comprising:

an inner race defining an inner diameter and an outer diameter, the inner diameter configured to receive a flagpole;

an annular outer race adapted to be received on the inner race, the outer race defining an inner circumference having a diameter larger than the outer diameter of the inner race, so as to define an annular cavity between the inner race and outer race, wherein the outer race has means for attaching the device to a flag;

a plurality of roller bearings residing in the annular cavity; and a cap attached to the inner race to hold the outer race and inner race together.

2. The flag anti-wrapping device of claim 1, wherein a bottom of the inner race has a first radially extending circumferential lip and wherein a bottom of the cap has a second radially extending circumferential lip to retain the bearings in the races.

3. The flag anti-wrapping device of claim 2, wherein the roller bearings have a proximal end closely spaced with respect to the second radially extending circumferential lip and a distal end closely spaced with respect to the first radially extending circumferential lip, whereby the roller bearings are held in place between the first lip and the second lip.

4. The flag anti-wrapping device of claim 1, wherein the inner race has a first annulus extending from a top of the inner race and wherein the cap has a second annulus extending from a top of the cap, and wherein the first annulus and the second annulus have means for attaching to each other, whereby the device is unitary.

5. The flag anti-wrapping device of claim 4, wherein the means for attaching include a first hole on the inner race and a second hole on the cap, whereby the first and second holes can be aligned to receive a fastener to hold the inner and outer race together.

6. The flag anti-wrapping device of claim 4, wherein the means for attaching include a plurality of inner threads in the cap, and a plurality of outer threads in the inner race configured to receive the inner threads, whereby the inner threads and outer threads can be twisted to hold the inner and outer race together.

7. The flag anti-wrapping device of claim 4, wherein the means for attaching include an adhesive.

* * * * *